United States Patent [19]

Clark et al.

[11] 4,046,131

[45] Sept. 6, 1977

[54] TENNIS BALL COLLECTION, PICK-UP AND PROPELLING SYSTEM

[75] Inventors: Thomas S. Clark, Palo Alto; William S. Kennedy, San Jose; Robert L. Piziali, Stanford, all of Calif.

[73] Assignee: American Tennis Systems, Inc., Sunnyvale, Calif.

[21] Appl. No.: 641,080

[22] Filed: Dec. 15, 1975

Related U.S. Application Data

[63] Continuation of Ser. No. 386,308, Aug. 7, 1973, abandoned.

[51] Int. Cl.[2] ..... F02B 33/10

[52] U.S. Cl. ..... 124/71; 124/41 R; 124/51 R; 124/51 A

[58] Field of Search ..... 273/26 A, 29 R, 30, 273/26 D, 29 A; 124/56–77, 11 R, 41 R, 51 R, 51 A, 1, 15, 35, 38, 45, 80, 81, 83–85; 302/2 R

[56] References Cited

U.S. PATENT DOCUMENTS

| | | | |
|---|---|---|---|
| 2,508,461 | 5/1950 | Lemon | 273/30 |
| 2,526,018 | 10/1950 | Foster et al. | 124/73 |
| 2,574,408 | 11/1951 | Moe | 124/73 |
| 3,855,988 | 12/1974 | Sweeton | 124/82 X |
| 3,917,265 | 11/1975 | Schrier et al. | 273/30 |

*Primary Examiner*—Richard C. Pinkham
*Assistant Examiner*—T. Brown
*Attorney, Agent, or Firm*—Gerald L. Moore

[57] ABSTRACT

A tennis ball retrieving and propelling device for placement on a surface having a ball delivery tube and a carrousel type ball retriever positioned below the ball delivery tube for receiving balls to be pneumatically transported to the ball delivery tube. The delivery tube is provided with a mechanism for constricting the effective cross sectional area thereof. The mechanism is provided with a releasing element for releasing the constriction to permit a ball to be pneumatically propelled through the tube. The mechanism includes a section of flexible tubing attached to the delivery tube, a cable surrounding the flexible tubing and a device attached to the cable for tensioning and releasing the cable to restrict and release a ball traveling through the flexible tube. The balls are pneumatically retrieved and propelled from the propelling device. The propelling device has elements for controlling the speed, azimuth and elevation of a ball delivered therefrom.

9 Claims, 13 Drawing Figures

FIG. 1
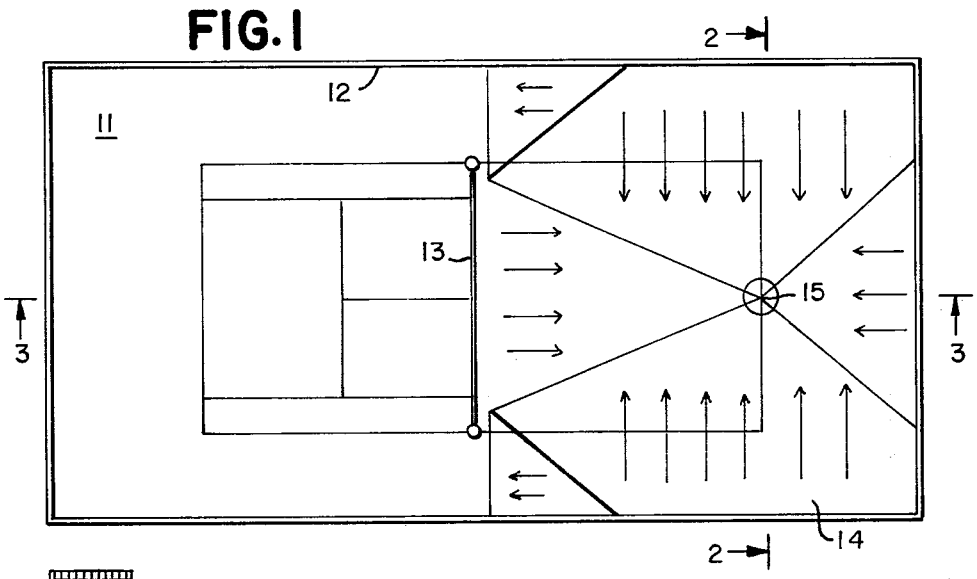
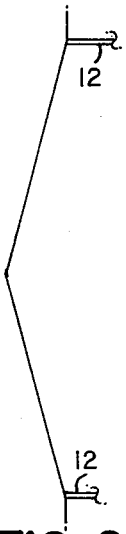
FIG. 2
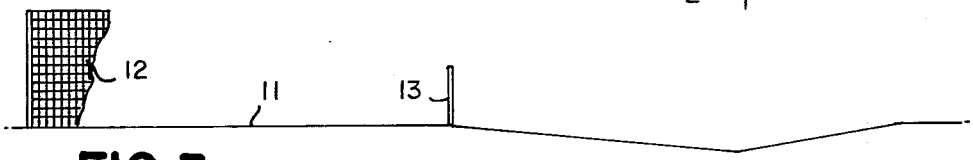
FIG. 3
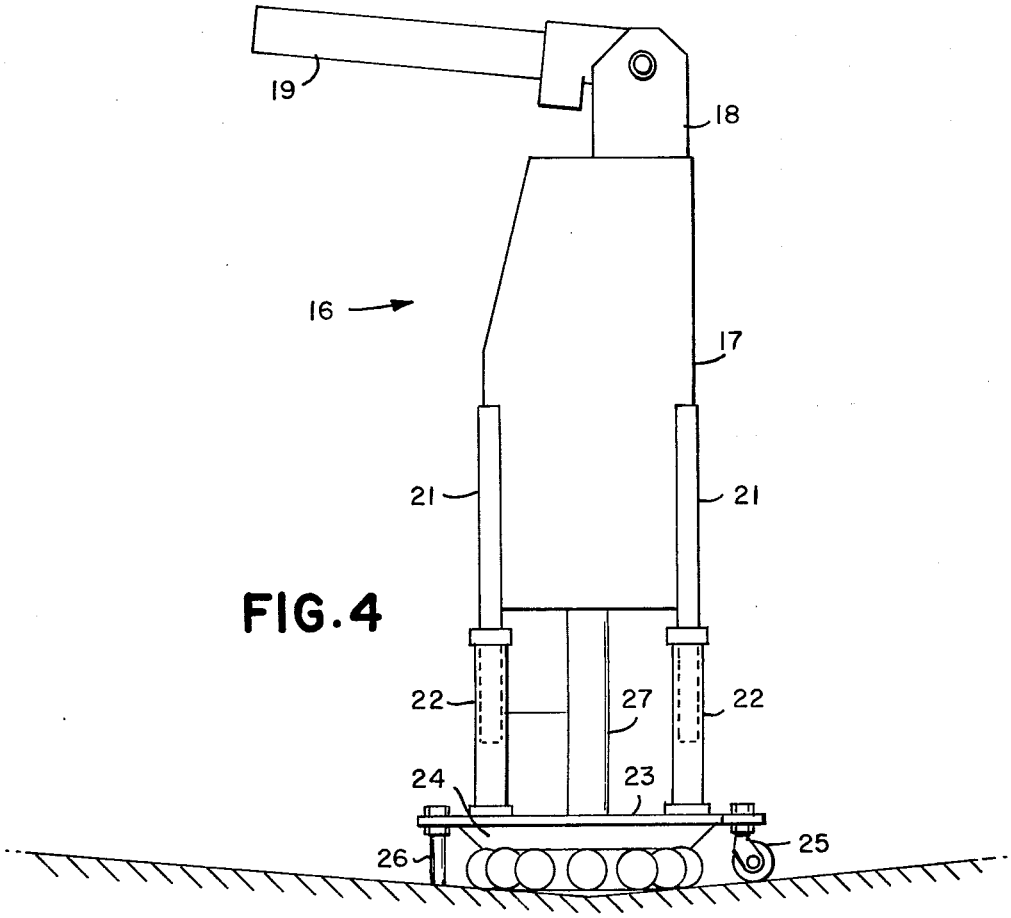
FIG. 4

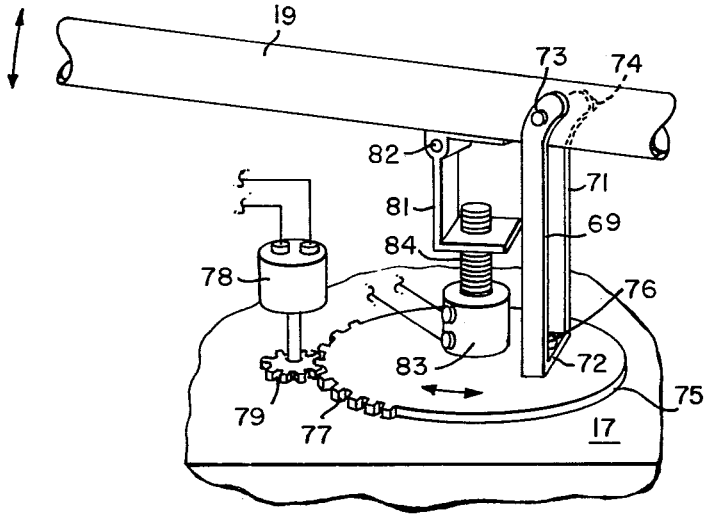
FIG. 9
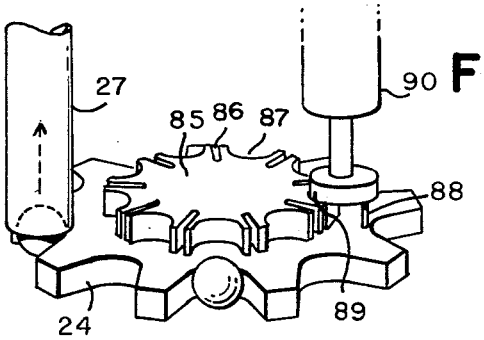
FIG. 10
FIG. 11
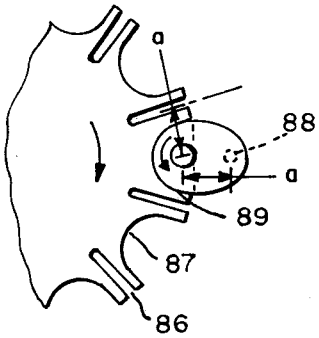
FIG. 12
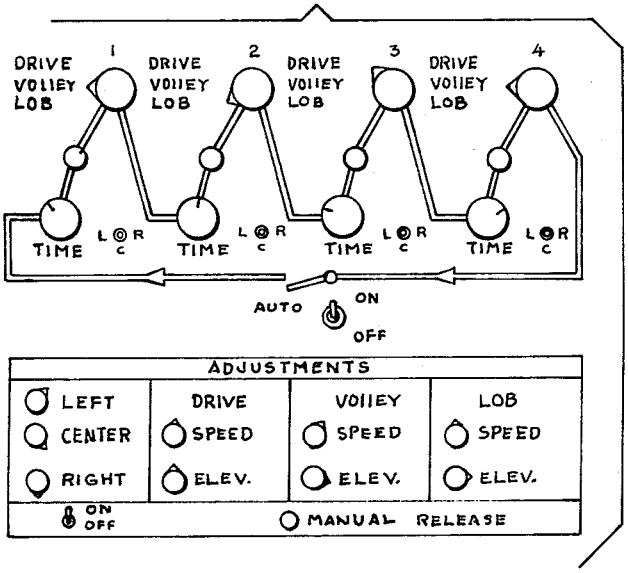
FIG. 13
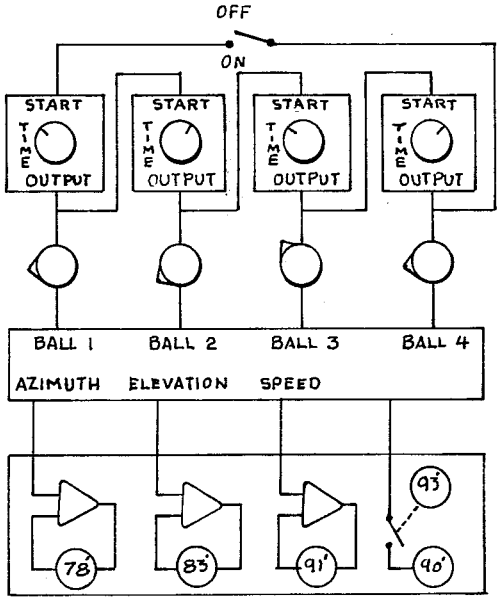

TENNIS BALL COLLECTION, PICK-UP AND PROPELLING SYSTEM

This is a continuation, of application Ser. No. 386,308, filed Aug. 7, 1973 since abandoned.

BACKGROUND

The present invention relates to a tennis ball collecting pick-up and propelling system and more particularly to a ball-propelling device for automatically retrieving, loading and then propelling tennis balls in a sequence over a wide range of directions and trajectories.

Heretofore, tennis instruction has generally been provided on a conventional tennis court with the instructor or an assistant positioned in the back court on one side off the net to hit balls across the net to the student. Ball-propelling devices have been proposed for propelling a magazine of balls in sequence, but with such devices the trajectory of the ball is determined by pointing the entire device and fixing the speed of the ball. Such devices permit practice on a given stroke for a limited period of time, until the magazine is emptied. The balls must then be manually retrieved and loaded into the magazine. The device can then be positioned to propel the ball on the same or another given trajectory for additional practice. This type of instruction is suitable for beginners, in that it limits the practice to a single stroke per magazine, but the constant speed and trajectory of the ball is monotonous and of limited instructional valve to an intermediate or advance player. In addition, a substantial percentage of the overall time is devoted to retrieving the balls and reloading the magazine.

SUMMARY OF INVENTION

The present invention avoids the shortcomings of the prior known approaches by provision of a tennis ball collecting, pick-up and propelling system for automatically retrieving, loading and propelling tennis balls and which incorporates a ball-propelling device which can be programmed by the user to deliver an easily selectible variety of repetitive shots or a sequence of different shots delivered in any desired order and suitable for the advanced or intermediate player as well as the beginner. This is accomplished by provision of an enclosed area which is divided by a tennis net, the area on one side of the net forming an approximate half-court playing surface, while all, or a portion of, the area on the opposite side of the net slopes in all directions toward a shallow depression. A ball-propelling device is located in the depression and includes sequentially operable means for queing balls on the surface of the depression and presenting them in sequence to a pneumatic pick-up device. Transport means is provided for transporting the ball to a delivery tube and pneumatic means is provided for propelling the ball from the delivery tube. Control means on the device permits selection of speed, trajectory and azimuth of the ball to suit the requirements of the player.

Other objects and many of the attendant advantages of this invention will be readily appreciated as the same becomes better understood by reference to the following detailed description when considered in connection with the accompanying drawing wherein:

DRAWINGS:

FIG. 1 is a plan view of a tennis practice and instruction facility according to the preasent invention;

FIG. 2 is a section taken on line 2—2 of FIG. 1;

FIG. 3 is a section taken on line 3—3 of FIG. 1;

FIG. 4 is a side view of a ball-propelling machine according to the present invention;

FIG. 9 is a partial view in perspective of the elevation and azimuth adjusting mechanism;

FIG. 10 is a view of the ball carrousel mechanism;

FIG. 11 is a partial view at an enlarged scale of the incremental stepping mechanism of FIG. 10;

FIG. 12 is a view of the control panel of the machine of FIG. 4; and

FIG. 13 is a schematic view of the control logic used in the present invention.

DETAILED DESCRIPTION

Figure 5:
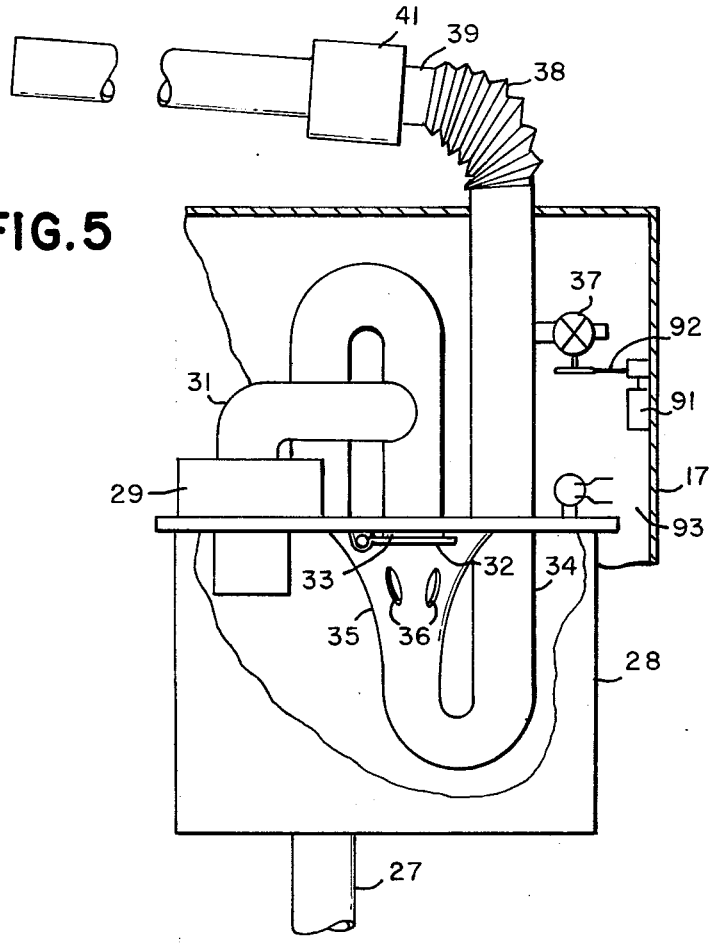
FIG. 5 is an elevation view partly in section of a preferred embodiment of a ball-propelling machine.

Referring to the drawings, a tennis practice and instruction facility according to the present invention is illustrated in FIG. 1 as including a generally rectangular, hard surface area 11 surrounded by a suitable woven wire fence 12. A tennis net 13 divides the longitudinal dimension of the area 11 and a half-court tennis playing surface is laid out on one side of the net. The area on the side of the net removed from the tennis playing surface is sloped to form a ball-return area. As illustrated in FIGS. 2 and 3, the ball-return area is sloped in four directions to form a depression 15. The low point of the depression 15 is located at what would be the approximate mid-point of the base line if a tennis playing surface were laid out on the ball return area.

Referring to FIG. 4 of the drawings, a tennis propelling machine 16 is depicted as including a cabinet 17, a moveable head 18 mounted on the upper surface of the cabinet, and a ball delivery tube 19 supported in the head. The cabinet is supported on a plurality of telescopic frame members 21, 22 which are mounted on the upper surface of a base 23. A ball-queing carrousel 24 is mounted on the lower surface of the base 21 while a series of casters 25 and at least one rigid leg 26 are mounted adjacent the edges of the base to support the carrousel in close proximity with the supporting surface.

The operating mechanism of a preferred embodiment of the ball-propelling machine is illustrated in FIG. 5. A ball pick-up tube 27 is mounted on the base and extends therethrough with the open end in close proximity with the carrousel. The pick-up tube extends vertically through the lower surface of the cabinet 17, makes a reverse bend and the opposite end is connected to the upper surface of a closed container 28. A pneumatic pump or blower 29 is mounted on the upper surface of the container with the suction side of the blower connected through a conduit 31 to the pick-up tube between the reverse bend and the top of the container. The pressure side of the blower is connected to the interior of the container. A door 32 is mounted on the lower surface of the top of the container and is biased to the closed position by spring loading or suitable counterweights. The door 32 is provided with a suitable seal 33 to fit over and seal the open end of the pick-up tube 27. A ball transport tube 34 is connected through a bell-shaped section 35 to the bottom surface of the top of the container surrounding the door 32. The bell-shaped section is slotted or perforated as at 36. The transport tube extends below the bell-shaped section and is provided with a reverse bend and then protrudes through the upper surface of the cabinet 17. A bleed valve 37 is connected to the transport tube between the container and the upper surface of the cabinet and is also connected to a reversible motor 91 through a suitable drive mechanism such as the chain and gear arrangement shown at 92. A section of flexible tubing 38 connects the upper end of the transport tube with the inlet 39 of the delivery tube 19. A ball-release mechanism 41 is mounted in the ball delivery tube adjacent to the inlet 39. A pressure responsive switch 93 is mounted on the container or transport tube below the bleed valve.

Figure 6:
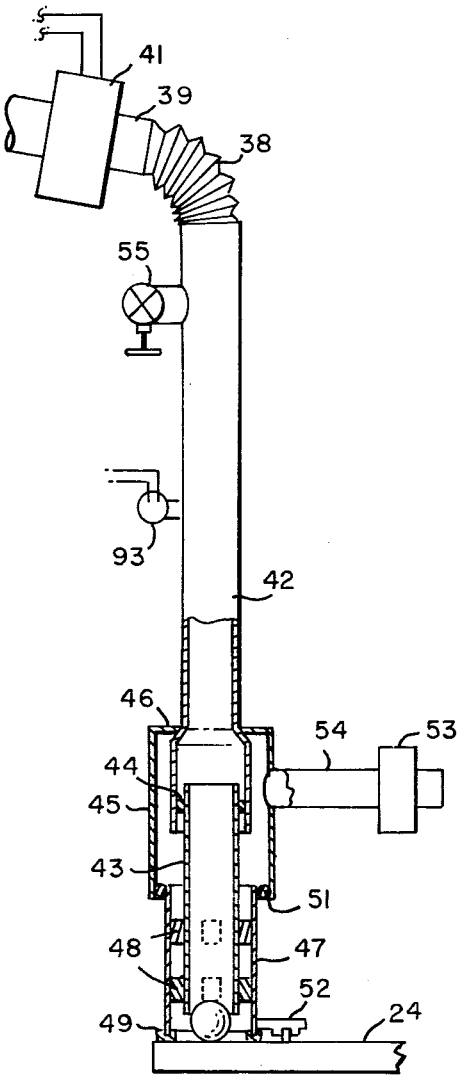

Referring to FIG. 6, an alternative form of pneumatic ball pick-up is illustrated. In this embodiment, a pick-up tube includes a fixed section 42 and a moveable section 43 which is telescoped within section 42. A rubbing seal 44 seals the annular space between the fixed and moveable sections and permits relative axial movement therebetween. A generally cylindrical shroud 45 surrounds the telescoped portions of sections 42 and 43 and is secured to section 42 by means of an annular section 46. A tube 47, which is somewhat larger in diameter than the pick-up tube is positioned in concentric relation with the free end of section 43. The tube 47 is maintained in spaced relation with section 43 by means of spacers 48 which are perforated or segmented to define an annular passageway between section 43 and tube 47. The lower end of tube 47 extends below the free end of section 43 and is provided with an annular compressible seal 49. The upper end of tube 47 is received within shroud 45 and is sealed thereagainst by means of an annular rubbing seal 51. A cam follower 52 protrudes laterally from the tube 47 and bears against a cam surface (not shown) on the upper surface of the carrousel 24. A blower 53 is connected through a conduit 54 to the shroud 45. A bleed valve 55 is connected to the fixed section 42 and a pressure responsive switch 93 is similarly connected to the fixed section below the bleed valve.

Figure 7:
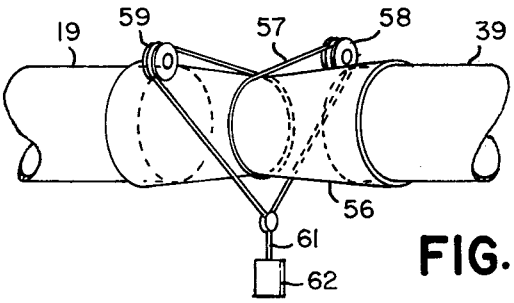
FIG. 7 is a perspective view of a ball release mechanism for use with the ball-propelling machine of the present invention.

FIG. 7 illustrates the structure of a suitable ball release mechanism 41. This structure includes a section of flexible tubing 56 which is connected between the inlet 39 and the delivery tube 19. A cable 57 encircles the midpoint of the flexible tubing and passes over a pair of spaced, fixed cable pulleys 58 and 59 and is secured to the armature 61 of a solenoid 62.

Figure 8:
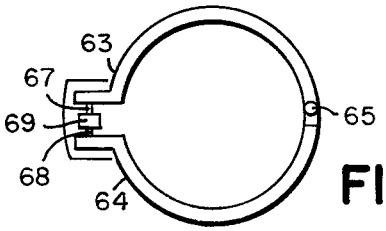
FIG. 8 is an elevation view of an alternative ball-release mechanism for use with the ball-firing machine of the present invention.

An alternative form of ball release mechanism is illustrated in FIG. 8 as including an annular ring mounted between the inlet and the delivery tube. The annular ring is split into two halves 63 and 64 which are pivotally mounted at one end by pin 65 while the other end of each half is connected to the oppositely directed armatures 67 and 68 of a solenoid 69.

FIG. 9 shows an elevation view at an enlarged scale of the interior mechanism of the head 18 of FIG. 4. The ball delivery tube 19 is pivotally supported between the upstanding distal ends of the arms 69 and 71 of a U-shaped bracket 72, such as by the pivot pins 73 ad 74. The bracket is secured to the upper surface of a plate 75 which is pivotally secured to the top of the cabinet 17, such as by a in 76. The edge of the plate 75 removed from the pin 76 is machined to an arcuate configuration and provided with a gear surface 77. A reversible motor 78 is connected to a drive gear 79, which is drivingly engaged with the gear surface 77. Alternatively the plate may be driven in any suitable manner, such as by a motor driven eccentric cam received within an elongated slot in the plate. An L-shaped bracket 81 is pivotally connected to the lower surface of the ball delivery tube 19 as at 82. A reversible motor 83 is positioned on the upper surface of the plate 75 and is drivingly engaged with the bracket 81 by means of a lead screw 84 threadedly received within an opening in the bracket. Alternatively the motor 83 can be drivingly connected to the ball delivery tube by means of a sprocket chain and a pair of sprocket gears.

Referring to FIG. 10 of the drawings, the ball-queing carrousel 24 is illustrated as a cylindrical member having a series of recesses formed around its perimeter. The recesses are of sufficient size to receive a tennis ball therein and are closely spaced about the periphery of the carrousel. The pneumatic pick-up tube 27 is positioned adjacent the periphery of the carrousel in vertical alignment with one of the recess positions. The carrousel is of sufficient height that the walls of the recesses form an extension of the pick-up tube when they are in alignment with the tube. A geneva type incrementing mechanism is connected to the carrousel and includes a circular plate 85 having a series of radially extending slots 86 and semi-circular recesses 87 formed in its periphery. The slots 86 and recesses 87 alternate and are located an even distance apart about the periphery of the plate. A motor 90 is connected to a rotatible member which includes a cylindrical guide surface 89 and an eccentrically mounted pin 88.

The controls for the ball-propelling machine are mounted in a control box which is hardwired to the machine with sufficient cable to allow the positioning of the box at the hitting station, i.e., at the half-court playing surface removed from the machine. This allows for quick, easy and continuous machine control. The exterior of the control box is provided with a control panel such as illustrated in FIG. 12. The control panel includes an on-off switch, a manual release button and an automatic sequence switch. A series of knobs are provided for setting the speed and elevation of each type of shot and for setting three azimuth positions, i.e., left, center and right. Associated with the automatic sequence switch are four shot selection knobs, switches for selecting an azimuth position for each shot, means for setting the time delay between shots and indicator lights for indicating the steps in the sequence.

OPERATION

In the operation of the facility illustrated in FIG. 1 the ball-propelling machine 16 is positioned in the depression 15 and then programmed to provide the shot selection and sequence desired. A supply of balls is dumped on the ball return area 14 where they roll down the sloped surfaces and come to rest adjacent the ball-propelling machine at the bottom of the depression. When the machine is turned on, the carrousel 24 rotates to deliver the balls individually through the pneumatic pick-up tube 27. The balls are picked up one at a time and propelled across the net to the student on the half-court playing surface. The machine is provided with controls whereby the speed of the ball and the elevation and azimuth of the delivery tube 19 are adjustable according to the wishes of the instructor or player. A pre-determined sequence of shots, i.e., lobs, volleys, drives, forecourt, ballcourt, forehand, backhand, etc., can be set into the machine which will then index through the sequence deliverying the balls at predetermined intervals. If unchanged, the sequence is then repeated. All balls returned by the student are carried by the sloped surfaces of the ball return area to the vicinity of the machine and are automatically picked up and used again.

In the ball-propelling machine of FIG. 4, the carrousel 24 is driven by an electric brake motor 90 through a suitable stepping mechanism, such as a Geneva mechanism as illustrated in FIG. 10. The carrousel motion starts a half step from the pneumatic pick-up position. When, the motor 90 is energized it rotates the circular guide and eccentric pin and advances the carrousel a half step by means of the eccentric pin 88 engaging in one of the slots 86, until a ball is located directly under the pick-up tube 27. The carrousel remains at this position during the hold phase of the Geneva cycle as the circular guide surface 89 is rotated within a recess 87 while the ball is pneumatically lifted from the recess in the carrousel. The carrousel is then advanced another half step by the Geneva mechanism and is stopped through contact with a limit switch (not shown). The empty recess in the carrousel then has a full rotation of 360° in which to entrap another ball. A stirring mechanism can be attached to the carrousel to assist in distributing the balls evenly within the storage area to insure that each carrousel recess is filled before it returns to the pick-up station.

The pick-up tube 27 in the preferred embodiment of FIG. 5 is connected to the vacuum side of the blower 29. The air flow through the pick-up tube due to the negative pressure created by the blower lifts the ball into the tube, accelerates it vertically and then causes it to traverse the reverse bend. The sides of the recesses in the carrousel form an aerodynamic shroud for directing the negative pressure against the ball instead of allowing it to spread out and be dissipated before the ball is picked up. In addition, a protuberance or ramp may be positioned on the supporting surface below the pick-up station to elevate the ball in the recess and raise it into close proximity with the open end of the pick-up tube. The aerodynamic shroud and protruberance or ramp focus the negative pressure directly on the ball and enhance the efficiency of the pick-up with a reasonable sized blower, i.e., vacuum cleaner type. Otherwise, a larger blower would be required with consequent increase in cost.

The ball having traversed the 180° bend accelerates downward and its momentum forces the door 32 open allowing the ball to pass to door 32 and continue into the bell section 35. Positive pressure in container 28 is communicated through perforations 36 into the interior of the bell section and the transport tube 34. After the ball passes through the door, the biasing in combination with the positive air pressure closes the door against the seal 33. The pressure difference across the blower then maintains the door against the seal. When the ball enters the bell section 35, it is expelled into the transport tube 34 by the positive pressure and passes downwardly through the reverse bend and upward vertically to the flexible tube 38 and into the inlet 39 where it comes to rest against the ball release mechanism. The ball release mechanism, as shown in FIG. 7, includes a section of flexible tubing 56 around which the cable 57 is looped. The opposite ends of the cable are fastened over the pulleys 58 and 59 and then connected to the armature 61 of a pull-type solenoid 62. When the solenoid is activated, the cable is pulled tight around the flexible tubing to restrict the ball from passing through. With the ball held in the inlet by the cable, the blower builds up pressure in the ullage behind the ball. With the ball release mechanism of FIG. 8 the pull-type solenoid 66 maintains the two halves of the ring in their contracted position where they restrict the ball from passing. The bleed valve 37 on the transport tube, or on container 28, is adjusted by the reversible motor 91 actuating through a gear and chain drive 92 to establish a desired equilibrium pressure in the ullage, and consequently a desired ball speed. When the release command is given, the solenoid is deactivated, releasing the cable or the ring halves. The ball is then accelerated through the release mechanism and out of the delivery tube by the ullage pressure and blower output.

The pneumatic pick-up of the embodiment of FIG. 6 relies upon positive pressure from the blower 53. The moveable section 43 of the pick-up tube is telescoped within the end of the fixed section 42 and is moveable vertically thereof. A relatively short tube section 47 of larger diameter is positioned in concentric relationship with the moveable section and is secured thereto by a series of annularly segmented spacers 48. The spacers define an annular air passage between the moveable sections. The lower end of tube 47 extends below the distal end of section 43 while the upper end of the tube is telescoped within the cylindrical shroud 45. As the carrousel 24 rotates a half step, the tube 47 is raised, such as by cam follower 52 riding upon a face cam on the carrousel. A further half step movement of the carrousel positions the ball beneath the moveable section 43. Tube 47 is then lowered by the cam follower and brings the compressible seal 49 into contact with the carrousel surface. At the same time, the distal end of the moveable section surrounds the ball. Positive pressure from the blower is then transmitted through conduit 54, shroud 45, the annulus between the moveable section 43 and tube 47 and is ported around the end of section 43 against the underside of the ball. Tube 47 is sealed against the inner surface of the shroud by sliding seal 51 and against the upper pressure from the blower then lifts the ball into the moveable section and forces it vertically through the fixed section 42 into the inlet in a manner similar to the device of FIG. 5. Pressure within the ullage and consequently the discharge speed of the ball is controlled by bleed valve 55 in a manner similar to valve 37 of FIG. 5.

The speed with which the ball is fired is controlled by the bleed valve which is operated by the reversibel AC motor 91. The azimuth of the ball is controlled by the position of plate 75 and is set by the reversible AC motor 78 driving through gear 79 and gear surface 77. The elevation of the ball is controlled by the vertical position of the delivery tube as set by reversible AC motor 83 driving the lead screw 84 to position the L-shaped bracket 81. These three motors are geared to feedback potentiometers 91', 78' and 83' (FIG. 13) which monitor the positions of the bleed valve, the plate and the firing tube, respectively. The control of these electromechanical functions is accomplished through servo-electronic control of the three reversible motors. The timing of the functions is accomplished through the logic circuitry of FIG. 13 which provides a number of individually controlled shot positions. Each of these positions has an adjustable timing circuit which allows the delay time before the shot to be set from 2 seconds to 10 seconds. Each position also determines the type of shot to be delivered. The present machine has three independently controlled shots from which to select, i.e., drive, volley and lob. The ball speed and the elevation angle of the delivery tube are adjustable at the control box through control knobs (potentiometer) settings. Thus the initial machine adjustment would be to establish the available shots. By the above controls, a lob, drive and volley could be set as the three available shots. The azimuth of the delivery tube has three adjustable positions. Each of the timed positions permits selection of the left, center or right positions. An oscillating mode which alternately delivers balls at two or three adjustable horizontal angles can be selected by sequencing the azimuth selector switches appropriately. The present machine can be set in an automatic mode which causes it to cycle through the four or more time positions and then to repeat itself continuously. When a ball is delivered, the stepping mechanism is activated, the ball release solenoid 62 is reactivated, and the control of the machine is advanced to the next desired position. At this position, the timing circuit is immediately activated. The type of shot selected for that position establishes the potentiometer position for ball speed, azimuth and elevation control. These are compared with the potentiometer positions at the control motors and voltage is supplied to the control motors to reduce any differences to zero. During this time the stepping mechanism has advanced a half step, loaded a ball into the pick-up tube and advanced another half step, all automatically. With the ball in the inlet, the delivery tube properly positioned and the ullage pressure established, the timer continues until its delay time is reached and then the release solenoid 62 is deactivated. The ball is then delivered on trajectory selected and the cycle is repeated at the next position. The pressure responsive switch 93 senses the ullage pressure and opens the control circuit to the carrousel to prevent pick-up of a second ball until the first ball is release from the delivery tube. The switch 93 thus acts as a safety switch to prevent more than one ball at a time being elevated into the release position. A manual control option is also available to release a ball and advance the carrousel each time a button is pushed. While a feedback control system has been illustrated the device can be controlled in any suitable mode, for instance, the use of reversible motors allows incorporation of limit switches to operate in a bang-bang mode.

The integration of the machine to various ball retrieval systems is greatly enhanced by the ability of the machine to pick up balls at ground level. With a sloped court, such as shown in FIG. 1 for gravity retrieval, the machine can simply be set at the low point of the slope. With a net retrieval system, the machine is positioned on a sloped disc. The disc is supported on the ground on top of the net and inside a net support ring. The net passes over the ring and under the disc, thus keeping the net height at the disc edge slightly higher than the disc height. Balls then roll down the net onto the disc and into the carrousel. The disc can also be supplied with elevated sides to act as a large volume storage ullage when the machine is used without a retrieval system.

The delivery tube height can also be adjusted by varying the base to cabinet height. This allows the ball to be delivered at a position about 3 feet above the playing surface using both the gravity and net retrieval systems. The delivery tube height can also be increased to approximately 9 feet above the playing surface to simulate a serve. This allows for serve return practice by the student.

Obviously many modifications and variations of the present invention are possible in the light of the above teachings. It is therefore to be understood that within the scope of the appended claims, the invention may be practical otherwise than as specifically described.

We claim:

1. A ball-propelling device comprising in combination a delivery tube having a bore of sufficient size to permit easy passage of a ball therethrough and having an entrance end formed to receive said ball and an exit end mounted to propel said ball along a predetermined trajectory;

ball release means adjacent the tube exit end for stopping passage of the ball therepast including a clamp movable to a first position squeezing the tube exit end to reduce the cross-sectional size sufficiently to prevent passage of a ball therepast such that the ball will be stopped for sealing the tube end against passage of air from within the tube and out of the exit end and movable to a second position releasing the external pressure of the tube to permit passage of a ball therepast;

means external to the tube energizable for moving the clamp selectively to the first and second positions;

means for introducing a ball into the entrance end and propelling it forward until it comes to rest adjacent the ball release means when the clamp is in the first position;

pressure means for introducing pressured air within the tube and between the ball and the tube entrance end; and means to activate the ball release means by energizing the means for moving the clamp to move the clamp to the second position to permit passage of the ball therepast and out of the tube exit end under the force of the pressured air within the tube for propelling the ball along a predetermined trajectory.

2. A tennis ball retrieving and propelling device adapted to be supported on a firm, relatively smooth surface comprising:

a ball delivery tube through which balls can be propelled and, including an inlet and an exit end;

ball loading means having an opening near the surface for receiving and moving said balls individually into the inlet of the delivery tube;

a ball release mechanism at said exit end for releasably constricting the effective internal area of the delivery tube and preventing passage of a tennis ball therethrough;

means external to the delivery tube energizable for actuating the ball release mechanism to release the delivery tube to allow passage of a ball therethrough;

pneumatic means for creating a high air pressure between the inlet end and the ball release mechanism; and means for energizing the means external to the delivery tube for actuating the ball release mechanism and allowing the ball to be propelled through the tube exit end under force of the high air pressure.

3. A tennis ball retrieving and propelling device as set forth in claim 2 wherein;

the ball release mechanism includes a section of flexible tubing attached to the delivery tube, a cable surrounding the section and said means external to the tube includes an actuator for tensioning the cable to contract the cross-sectional area of the flexible tube section.

4. A tennis ball retrieving and propelling device adapted to be supported on a firm, relatively smooth surface comprising:

a ball delivery tube through which balls can be propelled and, including an inlet and an exit end;

ball loading means having an opening near the surface for receiving and moving said balls individually into the inlet of the delivery tube;

a ball-queuing carrousel mounted on the device adjacent the supporting surface for rotation past the ball loading means for supplying one ball at a time thereto;

a ball release mechanism at the exit end for releasably constricting the effective internal area of the delivery tube and preventing passage of a tennis ball therethrough;

pneumatic means for creating a high air pressure between the inlet end and the ball release mechanism; and means for releasing the ball release mechanism and allowing the ball to be propelled through the tube exit end under force of the high air pressure.

5. A tennis ball retrieving and propelling device as set forth in claim 4 wherein;

the ball loading means includes a blower, a fixed transport tube and concentrically spaced inner and outer tube sections, the tube sections being telescopically connected to the transport tube, the blower including a pressure side connected to the outer tube section for pressurizing the space between the sections, and means for moving one of the tube sections into contact with the carrousel such that air pressure between the sections is diverted into the inner section to pick up a ball from the carrousel.

6. A tennis ball retrieving and propelling device as set forth in claim 4 including;

a blower having a pressure side connected to the ball delivery tube;

pressure control means connected to the blower and the tube;

an actuator connected to the pressure control means; and control means for energizing the actuator to vary the effective pressure supplied to the tube to thereby vary the speed at which successive balls are delivered by the device.

7. A tennis ball retrieving and propelling device as set forth in claim 4 including;

an azimuth motor drivingly connected to the tube for rotating the tube in a horizontal plane; and control means for energizing the azimuth motor to vary the azimuth at which successive balls are delivered.

8. A tennis ball retrieving and propelling device as set forth in claim 4 including;

an elevation motor drivingly connected to the tube for pivoting the tube exit end in a vertical plane; and control means for energizing the motor to vary the trajectory of the balls delivered by the device.

9. A tennis ball retrieving and propelling device as set forth in claim 4 wherein;

the pneumatic means includes a tube having an opening spaced distance above the supporting surface, and the carrousel includes a cylindrical member with spaced semi-circular recesses slightly larger than a ball formed around the periphery thereof, the carrousel being mounted for rotation of the recesses under the opening, and the walls of each recess forming an extension of the tube when it is aligned therewith.

* * * * *